United States Patent [19]

Arbter et al.

[11] 4,424,515

[45] Jan. 3, 1984

[54] ASSEMBLY FOR MOUNTING ANTENNA ON VEHICLE BODY

[75] Inventors: Erhard Arbter, Dauchingen; Ernst Steinhauer, Esslingen, both of Fed. Rep. of Germany

[73] Assignee: Richard Hirschmann Radiotechnisches Werk, Esslingen am Neckar, Fed. Rep. of Germany

[21] Appl. No.: 286,895

[22] Filed: Jul. 27, 1981

[30] Foreign Application Priority Data

Aug. 2, 1980 [DE] Fed. Rep. of Germany ..... 3029413

[51] Int. Cl.[3] ..... H01Q 1/32

[52] U.S. Cl. ..... 343/715; 174/153 A; 174/153 G

[58] Field of Search ..... 343/715, 889, 900, 901; 174/152 A, 153 A, 153 G

[56] References Cited

U.S. PATENT DOCUMENTS

| | | | |
|---|---|---|---|
| 2,499,137 | 2/1950 | Friedberg et al. | 343/889 |
| 3,122,746 | 2/1964 | Leonard | 343/889 |
| 3,254,344 | 5/1966 | Rohrs | 343/901 |

FOREIGN PATENT DOCUMENTS

| | | | |
|---|---|---|---|
| 1909339 | 2/1965 | Fed. Rep. of Germany . | |
| 1926267 | 11/1965 | Fed. Rep. of Germany . | |
| 1968167 | 9/1967 | Fed. Rep. of Germany . | |
| 17227481 | 11/1972 | Fed. Rep. of Germany . | |
| 2191292 | 1/1974 | France . | |
| 2192392 | 8/1974 | France . | |
| 2246986 | 5/1975 | France . | |
| 733865 | 7/1955 | United Kingdom | 343/901 |

*Primary Examiner*—Eli Lieberman

*Attorney, Agent, or Firm*—Karl F. Ross; Herbert Dubno

[57] ABSTRACT

An assembly for mounting an antenna on the body of an automotive vehicle comprises a substantially cylindrical mounting sleeve with an outwardly facing circumferential groove for gripping the edge of a preformed hole in the vehicle body upon an insertion of the sleeve through the hole in a mounting operation. The sleeve is formed with a substantially spherical inner surface in the region of the groove for engaging a matching spherical surface at one end of an antenna casing, the matching spherical surfaces providing a water-tight seal while enabling the casing to assume any of a plurality of orientations with respect to the vehicle body. The sleeve has a bellows-like wall formed at an end opposite the groove with a bead for engaging a cylindrical surface of the antenna casing in a water-tight form fit regardless of the orientation of the casing with respect to the body. A mounting bracket provides mechanical support and an electrical ground for the antenna casing.

8 Claims, 3 Drawing Figures

ASSEMBLY FOR MOUNTING ANTENNA ON VEHICLE BODY

FIELD OF THE INVENTION

Our present invention relates to an assembly for attaching an antenna to the body of an automotive vehicle. More particularly, our invention relates to such an assembly wherein the antenna is retractable into a casing lying in greatest part below a surface of the vehicle body.

BACKGROUND OF THE INVENTION

Antennas, whether comprising single rods or several telescoping sections, are generally retractable into casings or protective tubes within vehicle bodies to minimize dangers due to accidents, particularly low-speed accidents. The casings are frequently fastened with water-tight seals to the vehicle bodies at holes bored therein.

An antenna-mounting assembly wherein the retracted antenna projects a shortened distance from the surface of the vehicle body is described in German patent document (Gebrauchsmuster) No. 7,227,481. The assembly disclosed in that document has many complicated parts which are difficult and expensive to manufacture and assemble. Moreover, the assembly permits the mounting of the antenna only at a single angle with respect to the vehicle body. This singularity of allowable mounting angles severely limits in practice the locations on a vehicle where an antenna may be disposed. To increase the number of utilizable locations, a plurality of mounting assemblies must be produced, each with a respective set of component parts.

Some antenna-mounting assemblies, particularly those for motor-driven antennas, enable the nearly complete withdrawal of the antenna into the vehicle body but do not effectively inhibit the flow of water through the hole in the vehicle body. With these assemblies an antenna may not be fastened to that portion of the vehicle body overlying the trunk compartment, which limitation seriously reduces the places available for mounting an antenna.

OBJECTS OF THE INVENTION

An important object of our present invention is to provide an antenna-mounting assembly which is simple and inexpensive to produce and fasten to a vehicle body.

Another object of our present invention is to provide such an assembly which is fastenable to a vehicle body with a water-tight seal.

Yet another object of our present invention is to provide such an assembly which permits a plurality of orientations of the antenna with respect to the vehicle body.

SUMMARY OF THE INVENTION

An assembly for fastening a retractable antenna to the body of an automotive vehicle comprises, according to our present invention, an antenna casing in the form of a tube, an electrically conductive antenna rod slidably inserted in the casing and an elastic mounting sleeve provided at one end with an outwardly facing circumferential groove for gripping an edge of a preformed hole in the vehicle body upon an insertion of the sleeve through the hole during a mounting operation. The sleeve has a substantially spherical inner surface at the end including groove. The casing is provided with a socket connector for receiving an electrically conductive cable, thereby enabling the linkage thereof to the antenna rod, and has a distended end section with a substantially spherical outer surface engaging the spherical inner surface of the sleeve in a fluid-tight pressure fit upon an insertion of the casing into the sleeve during the mounting operation. The spherical surfaces of the sleeve and casing have essentially identical radii and coact to facilitate the inclination of the casing and the rod, within limited angles, with respect to an outer surface of the vehicle body in a region about the hole.

According to another feature of our present invention, the casing has a substantially cylindrical outer surface and an annular shoulder projecting therefrom at a distance from the spherical outer surface of the casing. In an unstressed state the sleeve has a substantially cylindrical wall formed with bellows-like undulations and, at an end of the sleeve opposite the groove, with an annular bead for gripping the cylindrical outer surface of the casing and for engaging the casing shoulder regardless of the angle of inclination of the casing with respect to the vehicle body in the region of the hole.

According to yet another feature of our present invention, the sleeve is provided in a region about the groove with an annular or circumferential wedge-shaped sealing lip projecting or pointing longitudinally in the direction of the bead. The lip bends radially outwardly to form a fluid-tight engagement with an outer surface of the vehicle body upon an insertion of the sleeve through the hole.

The casing, made of metal, is advantageously provided with a longitudinally extending metal flange fixable to the vehicle body by means of a metal bracket, the flange and bracket serving to mechanically support the casing as well as ground the same to the vehicle body. In addition, the casing is preferably formed with a recess having teeth which are engageable with the bracket for facilitating the support of the casing in any of a plurality of orientations with respect to the vehicle body in the region of the antenna hole.

In many applications an antenna may be mounted according to our present invention by means of a single piece, i.e. the sleeve. This sleeve is easy and inexpensive to manufacture; its installation on a vehicle body is accomplished by a simple manual operation. The swivelable mounting of the casing within the sleeve by means of the matching spherical surfaces, as well as the longitudinally compressible sleeve wall, enables the mounting of the antenna and its casing at any of a plurality of orientations with respect to the vehicle body while simultaneously preserving the effectiveness of the seal. Thus, a mounting assembly according to our present invention greatly increases the number of available mounting locations on an automobile body.

Generally, the grounding of the casing is implemented by a connection to the automobile body in the region of the mounting hole. The grounding of the casing via the flange and the bracket according to our present invention facilitates the reduction of corrosion in the region of the hole, enabling in part the effective application of a corrosion-resistant lacquer.

The life of the seal formed by the sleeve is maximized by the utilization of a soft elastic material, e.g. rubber, which is resistant to weather, fuel and washing solutions.

The bracket is provided with a slot for enabling the mounting thereof at various locations on an automobile body and on bodies of different makes and manufacture.

BRIEF DESCRIPTION OF THE DRAWING

These and other features of our present invention will now be described in detail, reference being made to the accompanying drawing in which.

SPECIFIC DESCRIPTION

Figure 2:
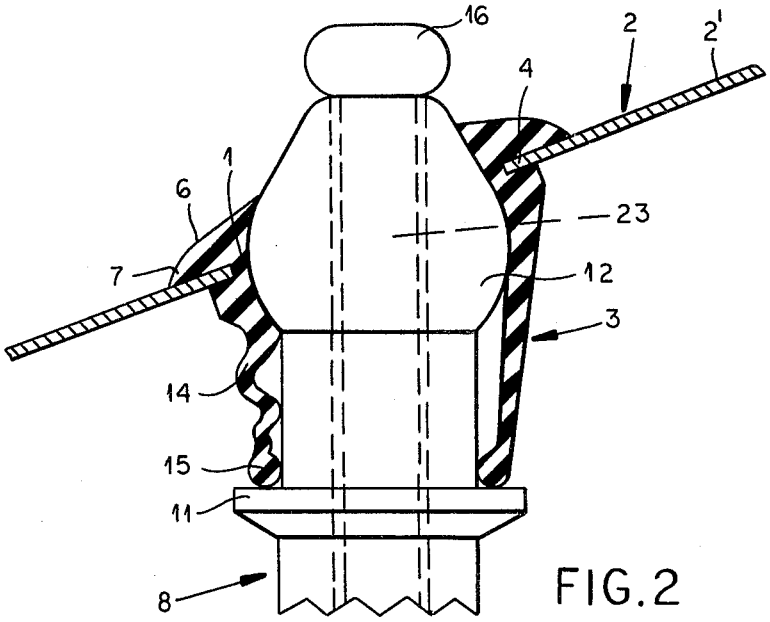
FIG. 2 is a view similar to FIG. 1, showing the casing at a different orientation with respect to the vehicle body in the region of the hole.

An assembly for fastening a retractable antenna to the body 2 of an automotive vehicle comprises, according to our present invention, a casing 8 in the form of a tube in which an electrically conductive rod 23 is slidably inserted (see FIG. 2). Rod 23 consists of a single piece or several telescoping segments and is provided at an outer end with a knob 16 for facilitating the manual withdrawal of the rod from tube 8.

Figure 1:
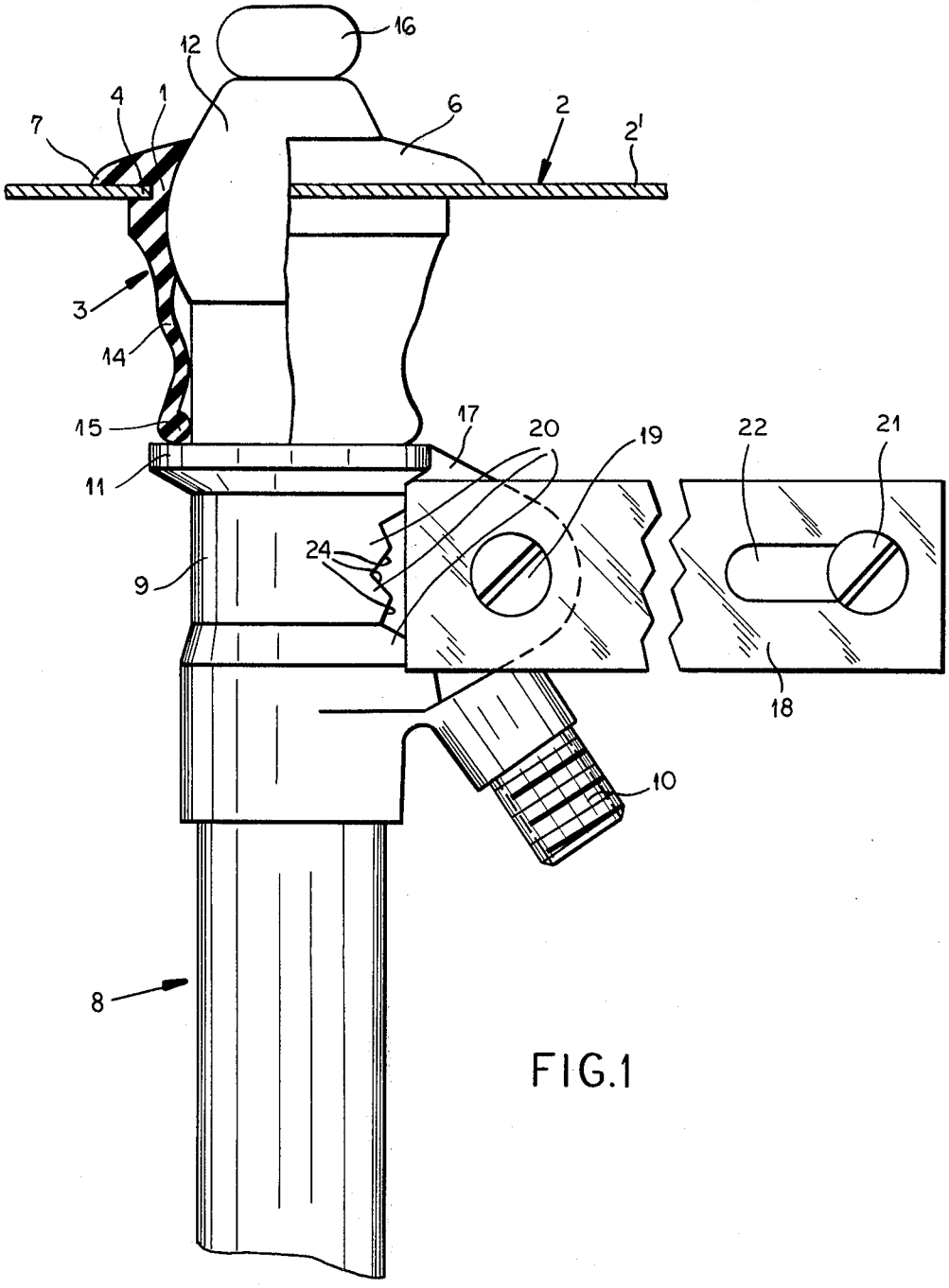
FIG. 1 is a side elevational view, partially in cross-section, of an antenna-mounting assembly according to our present invention, showing a rubber sleeve holding an antenna casing in a hole on the body of an automotive vehicle.
Figure 3:
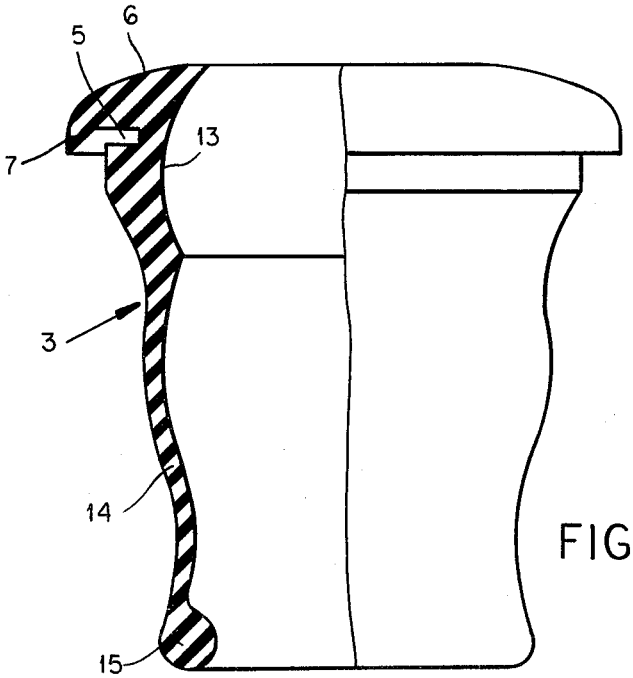
FIG. 3 is a side elevational view, partially in cross-section, of the mounting sleeve shown in FIGS. 1 and 2.

As illustrated in FIG. 1, casing 8 is mounted in a preformed hole 1 in body 2 by means of a rubber sleeve 3. As shown in FIG. 3, sleeve 3 is substantially in the form of a cylinder and is provided at one end with a circumferential or annular groove 5 facing radially outwardly for gripping an edge 4 of hole 1 upon an insertion of sleeve 3 through the hole from an upper side of the vehicle body. Sleeve 3 has an annular wedge-shaped lip 7 which projects longitudinally inwardly in an unstressed state of the sleeve. Upon a mounting of the sleeve in hole 1, lip 7 bends radially outwardly to form a water-tight pressure seal with an outer surface 2' of body 2. Lip 7 extends along the circumference of a curved end surface 6 of sleeve 3.

As illustrated in FIG. 3, sleeve 3 includes a substantially cylindrical wall 14 formed with bellows-like undulations in an unstressed state of the sleeve. At an end of sleeve 3 opposite surface 6 and groove 5 wall 14 is provided with an annular bead 15. As shown in FIGS. 1 and 2, upon an insertion of casing 8 into sleeve 3 bead 15 engages a shoulder 11 projecting from surface 9 and grips this surface in a fluid-tight pressure lock. The seal produced by bead 15 prevents the upward passage of water into sleeve 3 where the antenna-mounting assembly is secured to a fender of a vehicle.

Sleeve 3 has an essentially spherical inner surface 13 at an end of the sleeve opposite bead 15, i.e. in a region about groove 5, while casing 8 is provided with a distended section or bulge 12 having a substantially spherical outer surface of virtually the same radius as inner surface 13. Upon an insertion of casing 8 into sleeve 3, outer surface 12 engages inner surface 13 in a fluid-tight form fit in which casing 8 is swivelable within limits for assuming any of a practical multiplicity of orientations with respect to outer body surface 1' in the area of hole 1. Where the antenna-mounting assembly is fastened to a vehicle body overlying a trunk space, seal 9, 15 provides additional assurance that a fluid such as water cannot be forced under pressure through sleeve 3 into the luggage compartment.

As illustrated in FIG. 1, the undulations of wall 14 are exaggerated in whole or in part by compressive forces arising in an assembled state of tube 8 and sleeve 3. In cases where tube 8 extends perpendicularly to body surface 2' the undulations retain their symmetrical character. In cases where tube 8 assumes an angle with respect to surface 2', as shown in FIG. 2, the undulations are distorted differentially about the circumference of wall 14. In any event the elasticity of sleeve 3, as determined by the stretch characteristics of the rubber and by the thickness of wall 14, ensures that bead 15 remains in a fluid-tight engagement with surface 9 and shoulder 11. The thickness of the bellows wall, however, should not be so great as to prevent a reasonably facile insertion of tube 8 into sleeve 3 during a mounting operation.

The material of which sleeve 3 is formed, whether plastic or rubber, is advantageously of a composition resistant generally to weather and washing solutions and particularly to the corrosive effects of fuels, detergents and acidic rains.

Antenna casing 8 is preferably secured to a vehicle body by means in addition to sleeve 3. As shown in FIG. 1, such securing means preferably assumes the form of a brace or bracket 18 provided at one end with a slot 22 for facilitating the fixing of the antenna casing to different areas of the vehicle body and enabling the use of an antenna-mounting assembly according to our present invention in automobiles of different makes and models. A bolt 21 traverses slot 22 and is screwed to body 2.

At an end opposite slot 22 bracket or web 18 is attached by a screw 19 to a longitudinal flange 17 projecting from tube 8. This tube is advantageously provided with a recess formed with a plurality of teeth or serrations 20 which coact with bracket 18 to secure casing 8 and rod 23 in any of a plurality of different orientations with respect to body 2. One or two corners of bracket 8 engage surfaces 24 of teeth 20 upon the mounting of an assembly according to our present invention.

In addition to mechanically supporting casing 8, flange 17 and bracket 18 serve to electrically ground the casing. For this reason, the flange and the bracket, as well as casing 8, are formed from a metallic substance. As illustrated in FIG. 1, casing 8 carries a socket connector 10 for receiving an electrically conductive cable (not shown) connectable to rod 23.

It is to be noted that casing section 12 and knob 16 project but a small distance, e.g. at most one centimeter, from vehicle surface 2'. This distance is even less where antenna rod 23 is motor-driven, since knob 16 is not needed and the tip of rod 23 is entirely retractable into the casing.

We claim:

1. An assembly for fastening a retractable antenna to the body of an automotive vehicle, comprising:

an antenna casing in the form of a tube;

an electrically conductive rod slidably inserted and retractable in said casing, said casing being provided with means for facilitating the connection of an electrically conductive cable to said rod; and an elastic mounting sleeve provided at one end with an outwardly facing circumferential groove for receiving, flanking and gripping an edge of a preformed hole in said body upon an insertion of said sleeve through said hole during a mounting operation, said sleeve having a substantially spherical inner surface at said one end, said casing having at one end a distended section with a substantially spherical outer surface engaging said inner surface in a pressure fit and hugging said inner surface over a substantial part of the area thereof upon an insertion of said casing into said sleeve during said mounting operation, said spherical surfaces coacting to facilitate an inclination, within limited angles, of said casing and said rod with respect to a surface of said body in a region about said hole, said casing having a substantially cylindrical outer surface and an annular shoulder projecting therefrom and spaced from said spherical outer surface, said sleeve having in an unstressed state a substantially cylindrical wall formed with bellows-like undulations and at an end of said sleeve opposite said groove with an annular bead for gripping said cylindrical outer surface and for engaging said shoulder regardless of the angle of inclination of said casing with respect to a surface of said body in a region about said hole.

2. The assembly defined in claim 1 wherein said sleeve consists of a soft elastic material resistant to weather, fuel and washing solutions.

3. The assembly defined on claim 1, or 2 wherein said sleeve is provided in region about said groove with a circumferential wedge-shaped sealing lip projecting longitudinally in the direction of said bead, said lip bending radially outwardly to form a fluid-tight engagement with an outer surface of said body upon an insertion of said sleeve through said hole during said mounting operation.

4. The assembly defined in claim 3 wherein said casing is provided with a longitudinally extending flange, further comprising a bracket securable to said flange and to said body for fixing said casing thereto.

5. The assembly defined in claim 14 wherein said casing consists of a metallic material, said flange and said bracket being formed from an electrically conductive material for grounding said casing.

6. The assembly defined in claim 14 wherein said casing is formed with a recess having teeth engageable with said bracket for facilitating the support of said casing in any of a plurality of orientations with respect to a surface of said body in a region about said hole.

7. The assembly defined in claim 4 wherein said bracket is provided with a slot for enabling the mounting thereof at different locations on said body and on different vehicle bodies.

8. An assembly for fastening a retractable antenna to the body of an automotive vehicle comprising:

an antenna casing in the form of a tube;

an electrically conductive rod slidably inserted and retractable in said casing, said casing being provided with means for facilitating the connection of an electrically conductive cable to said rod;

a mounting sleeve of soft elastic material provided at one end with an outwardly facing circumferential groove for receiving, flanking and gripping an edge of a preferred hole in said body upon an insertion of said sleeve through said hole during a mounting operation, said sleeve having a substantially spherical inner surface at said one end, said casing having at one end a distended section with a substantially spherical outer surface engaging said inner surface in a pressure fit and hugging said inner surface over a substantial part of the area thereof upon an insertion of said casing into said sleeve during said mounting operation, said spherical surfaces coacting to facilitate an inclination, within limited angles, of said casing and said rod with respect to a surface of said body in a region about said hole, said casing having a substantially cylindrical outer surface and an annular shoulder projecting therefrom and spaced from said spherical outer surface, said sleeve having in an unstressed state a substantially cylindrical wall formed with bellows-like undulations and at an end of said sleeve opposite said groove with an annular bead for gripping said cylindrical outer surface and for engaging said shoulder regardless of the angle of inclination of said casing with respect to a surface of said body in a region about said hole, said sleeve being provided in region about said groove with a circumferential wedge-shaped sealing lip projecting longitudinally in the direction of said bead, said lip bending radially outwardly to form a fluid-tight engagement with an outer surface of said body upon an insertion of said sleeve through said hole during said mounting operation, said casing being provided with a longitudinally extending flange; and a bracket securable to said flange and to said body for fixing said casing thereto, said casing consisting of a metallic material, said flange, and said bracket being formed from an electrically conductive material for grounding said casing, said casing being formed with a recess having teeth engageable with said bracket for facilitating the support of said casing in any of a plurality of orientations with respect to a surface of said body in a region about said hole, said bracket being provided with a slot for enabling the mounting thereof at different locations on said body and on different vehicle bodies.

* * * * *